US010774462B2

(12) United States Patent
Ayers et al.

(10) Patent No.: US 10,774,462 B2
(45) Date of Patent: Sep. 15, 2020

(54) LAUNDRY TREATING APPLIANCE WITH SEPARATE CONTAINER

(71) Applicant: WHIRLPOOL CORPORATION, Benton Harbor, MI (US)

(72) Inventors: Kevin B. Ayers, Saint Joseph, MI (US); Seth E. Bixby, Stevensville, MI (US); Trevor R. Haney, Jenison, MI (US); Sayer J. Murphy, Saint Joseph, MI (US); Haley K. Rich, Saint Joseph, MI (US); Anna C. Schelling, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/196,788

(22) Filed: Nov. 20, 2018

(65) Prior Publication Data

US 2019/0177905 A1 Jun. 13, 2019

Related U.S. Application Data

(60) Provisional application No. 62/596,147, filed on Dec. 8, 2017.

(51) Int. Cl.

| | |
|---|---|
| ***D06F 58/20*** | (2006.01) |
| ***D06F 60/00*** | (2009.01) |
| ***D06F 58/04*** | (2006.01) |
| ***D06F 39/14*** | (2006.01) |

(52) U.S. Cl.

CPC ..... *D06F 58/20* (2013.01); *D06F 58/04* (2013.01); *D06F 60/00* (2013.01); *D06F 39/14* (2013.01)

(58) Field of Classification Search

CPC ..... D06F 58/20; D06F 58/04; D06F 60/00; D06F 39/14

USPC ..... 34/109, 595–610

See application file for complete search history.

(56) References Cited

U.S. PATENT DOCUMENTS

| | | | | | |
|---|---|---|---|---|---|
| 2,628,432 | A | | 8/1882 | Smith | |
| 3,316,659 | A | * | 5/1967 | Lauck | D06F 37/08 34/600 |
| 3,344,532 | A | * | 10/1967 | Bigler | D06F 58/04 34/600 |
| 4,091,548 | A | * | 5/1978 | Daily | D06F 58/04 312/311 |
| 4,684,787 | A | | 8/1987 | Bunting | |
| 5,519,949 | A | | 5/1996 | Gibson, Jr. | |
| 5,743,025 | A | * | 4/1998 | Jordan, Jr. | D06F 58/04 34/600 |
| 6,026,592 | A | * | 2/2000 | Herr | D06F 58/04 34/446 |

(Continued)

FOREIGN PATENT DOCUMENTS

| | | | | |
|---|---|---|---|---|
| DE | 10323494 A1 | * | 12/2004 | D06F 58/04 |
| EP | 1522625 A1 | | 4/2005 | |

(Continued)

*Primary Examiner* — Stephen M Gravini

(74) *Attorney, Agent, or Firm* — McGarry Bair PC

(57) ABSTRACT

An apparatus and method towards a laundry treating appliance for drying laundry comprising a rotatable drum at least partially defining a treating chamber and having a front and a rear and a motor rotating the drum that tumbles laundry within the treating chamber while also including a separate container for drying a second load of laundry simultaneously.

20 Claims, 10 Drawing Sheets

(56) References Cited

U.S. PATENT DOCUMENTS

| | | | | |
|---|---|---|---|---|
| 6,543,630 | B2 * | 4/2003 | Hope | D06F 58/04 211/133.5 |
| 7,228,646 | B1 * | 6/2007 | Purcell | D06F 58/04 34/104 |
| 7,313,933 | B2 | 1/2008 | Carey et al. | |
| 7,552,545 | B2 | 6/2009 | Crawford et al. | |
| 8,087,184 | B2 | 1/2012 | Banta et al. | |
| 8,499,592 | B2 * | 8/2013 | Gokceimam | D06F 39/14 312/228 |
| 8,661,707 | B2 * | 3/2014 | Dittmer | D06F 58/04 34/606 |
| 8,776,395 | B2 * | 7/2014 | Tatar | D06F 39/14 34/242 |
| 9,284,679 | B2 | 3/2016 | Ashrafzadeh et al. | |
| 9,850,622 | B1 * | 12/2017 | Lavernia | D06F 95/002 |
| 9,920,468 | B2 | 3/2018 | Hendrickson et al. | |
| 10,266,985 | B2 * | 4/2019 | Vaidhyanathan | D06F 58/04 |
| 10,398,285 | B2 * | 9/2019 | Blackman | D06F 58/20 |
| 10,494,755 | B2 * | 12/2019 | Heater | D06F 58/02 |
| 2010/0281925 | A1 * | 11/2010 | Gokceimam | D06F 39/14 68/19 |
| 2011/0025178 | A1 * | 2/2011 | Schone | D06F 39/14 312/228 |
| 2015/0153104 | A1 | 6/2015 | Bae et al. | |
| 2015/0240407 | A1 | 8/2015 | Hendrickson et al. | |
| 2016/0160424 | A1 | 6/2016 | Kim et al. | |
| 2019/0177905 | A1 * | 6/2019 | Ayers | D06F 60/00 |

FOREIGN PATENT DOCUMENTS

| | | | | |
|---|---|---|---|---|
| EP | 2415920 | A1 | 2/2012 | |
| EP | 3124676 | A1 | 2/2012 | |
| KR | 100634804 | B1 | 10/2006 | |
| WO | 0039383 | A1 | 7/2000 | |
| WO | WO-2004104289 | A1 * | 12/2004 | D06F 58/04 |

* cited by examiner

LAUNDRY TREATING APPLIANCE WITH SEPARATE CONTAINER

CROSS-REFERENCE TO RELATED APPLICATION(S)

This application claims priority to U.S. Provisional Patent Application No. 62/596,147, filed Dec. 8, 2017, which is incorporated herein by reference in its entirety.

BACKGROUND

Laundry treating appliances, in particular clothes dryers, can have a configuration based on a rotating drum that defines a treating chamber in which laundry items are placed for treating according to a cycle of operation. A controller can be operably connected with the dispensing system and can have various components of the laundry treating appliance to execute the cycle of operation. The cycle of operation can be selected manually by the user or automatically based on one or more conditions determined by the controller.

The effectiveness of the clothes dryer is based on how dry laundry is at the end of a cycle. Too dry of laundry, such as "bone dry" is harsh on the laundry and wastes energy as the laundry is over-dried, and not dry enough feels wet to the consumer, which can lead to an unnecessary service call. Typically, it is desired to stop the drying cycle when the laundry has a desired residual moisture content falling within a particular range (e.g., 2-4%). Sensors can be utilized to determine the moisture content in a load of laundry and communicate this information to the controller.

In some clothes dryers, a separate drying apparatus, such as a drying rack or a removable container, can be used for drying items separately from the standard tumbled load, i.e. delicates or shoes. Depending on the configuration, the separate drying apparatus can be used in place of or in combination with drying laundry in the treating chamber defined by the rotating drum.

SUMMARY

The present disclosure sets forth a laundry treating appliance for drying laundry comprising a rotatable drum at least partially defining a first treating chamber and having a front and a rear, at least one opening in the front providing access to the first treating chamber, a first door selectively movable between an opened position and a closed position to open/close the opening, and a separate container mounted to the door and disposed within the treating chamber when the door is in the closed position and configurable between a first and a second position, with the separate container forming a self-supporting structure in the second position.

The present disclosure further sets forth a laundry treating appliance for drying laundry comprising a rotatable drum at least partially defining a first treating chamber and having a front and a rear, at least one opening in the front providing access to the first treating chamber, a first door selectively movable between an opened/closed positions to open/close the opening, and a separate container rotatably mounted within the dryer with a set of bearings located between the front and the separate container and a turning blade extending into the first treating chamber.

DESCRIPTION

Figure 1:
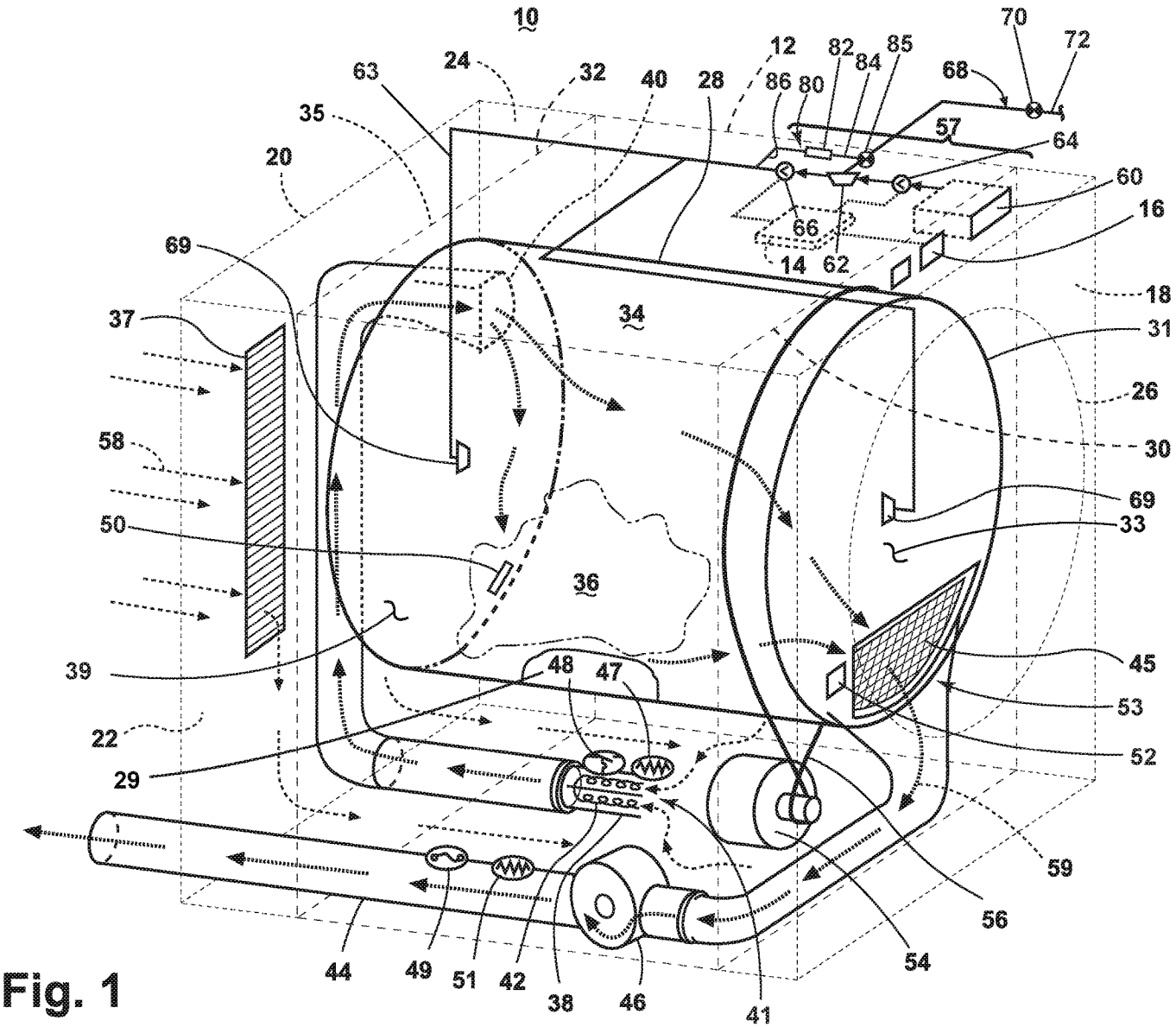
FIG. 1 is a schematic view of a laundry treating appliance in the form of a clothes dryer including sensors.

Aspects of the disclosure herein relate to a laundry treating appliance that includes a separate container. The separate container can be mounted or coupled to a door providing access to a treating chamber of the laundry treating appliance. In one configuration, the laundry treating appliance is a dryer having a controller capable of receiving information related to controlling a drying cycle for the dryer. The separate container is configured to receive laundry not suitable for a regular tumbling cycle within a main chamber of the dryer. By way of non-limiting example laundry not suitable for a regular tumbling cycle can include shoes and delicates.

The controller can be configured to receive information related to the presence of the separate container, the position of the separate container, a drying cycle with the separate container in use, a drying cycle without the separate container in use, maintenance issues for the separate container, or the like. The controller for the laundry treating appliance is not limited to these functions, and it should be understood that functions related to the controller discussed herein are for illustrative purposes only and not meant to be limiting.

In one aspect of the disclosure discussed herein the separate container is mounted to a door for the dryer and configured to contract and expand between first and second positions. The first position can be a stowed, contracted, or non-use position where the separate container is not necessary for a normal drying cycle of the dryer. The second position can be a treatment, expanded, or use position where the separate container is needed for, by way of non-limiting example, a delicate drying cycle.

In another aspect of the disclosure discussed herein, the separate container is removably mounted to the door for the dryer and configured to be placed in the door when needed for use. The removably mounted separate container can be an expandable container as well, spring loaded for easy storage, or can have a cage or framed body for holding laundry not suitable for tumbling in the main chamber of the dryer. It is further contemplated that the removably mounted container can have an outer frame configured to be covered in a mesh fabric where the mesh fabric can be utilized to hold in smaller laundry items when necessary. It is further contemplated that the removably mounted separate container can be coupled to the door with a ramped coupler. The ramped coupler can include a quarter turn ramp or a vertical ramp.

Furthermore, in yet another aspect of the disclosure discussed herein the separate container is rotatably mounted within the dryer. In this aspect, the separate container can rotate with or at a varying speed when compared to a main drum of the dryer. This separate container can be utilized for laundry items safe for tumbling and needing to be kept separate from a main laundry load for drying. Items such as undergarments or items with lose strings may be safe for tumbling and benefit from remaining separate so as not to become entangled with other laundry items during the drying process.

By way of overview, FIG. 1 is illustrative of an example of a laundry treating appliance in the form of a clothes dryer 10 that can be controlled according to aspects of the disclosure described herein. While aspects of the disclosure described herein are in the context of a clothes dryer 10, the disclosure is not so limited and can be used with any type of laundry treating appliance, non-limiting examples of which include a washing machine, a combination washing machine and dryer and a refreshing/revitalizing machine.

As illustrated in FIG. 1, the clothes dryer 10 can include a cabinet 12 in which is provided a controller 14 that can receive input from a user through a user interface 16 for selecting a cycle of operation and controlling the operation of the clothes dryer 10 to implement the selected cycle of operation.

The cabinet 12 can be defined by a front wall 18, a rear wall 20, and a pair of side walls 22 supporting a top wall 24. A chassis can be provided with the walls being panels mounted to the chassis. A door 26 can be hingedly mounted to the front wall 18 and can be selectively movable between opened and closed positions to close an opening in the front wall 18, which provides access to the interior of the cabinet 12.

A rotatable drum 28 can be disposed within the interior of the cabinet between opposing stationary front and rear ends comprising bulkheads 30, 32 wherein the front bulkhead 30 defines a front wall 31 of the drum 28 and rotationally supports an open front 33 and the rear bulkhead 32 defines a rear wall 35 of the drum 28 closing an open rear 39 of the drum 28. The rear wall 35 of the drum 28 along with the door 26 and the rotatable drum 28 collectively define a treating chamber 34. As illustrated, the treating chamber 34 is not fluidly coupled to a drain, though other implementations may include drain lines. Thus, in this implementation, liquid introduced into the treating chamber 34 will not be removed merely by draining. The rotatable drum is for tumble drying a main laundry load 36 within the treating chamber 34.

Non-limiting examples of laundry that can be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), can be treated in the clothes dryer 10.

The drum 28 can include at least one lifter 29. In most dryers, there can be multiple lifters. The lifters can be located along an inner surface of the drum 28 defining an interior circumference of the drum 28. The lifters can facilitate movement of the main laundry load 36 within the drum 28 as the drum 28 rotates.

The drum 28 can be operably coupled with a motor 54 to selectively rotate the drum 28 during a cycle of operation. The coupling of the motor 54 to the drum 28 can be direct or indirect. As illustrated, an indirect coupling can include a belt 56 coupling an output shaft of the motor 54 to a wheel/pulley on the drum 28. A direct coupling can include the output shaft of the motor 54 coupled to a hub of the drum 28.

An air system can be provided to the clothes dryer 10. The air system supplies air to the treating chamber 34 and exhausts air from the treating chamber 34. The supplied air can be heated or not. The air system can have an air supply portion that can form, in part, a supply conduit 38 with an air inlet 39 open to ambient air via a rear vent 37 and another end fluidly coupled to an inlet grill 40, which can be in fluid communication with the treating chamber 34. A heating element 42 can lie within the supply conduit 38 and can be operably coupled to and controlled by the controller 14. If the heating element 42 is turned on, the supplied air will be heated prior to entering the drum 28.

The air system can further include an air exhaust portion that can be formed in part by an exhaust conduit 44. A lint trap 45 can be provided as the inlet from the treating chamber 34 to the exhaust conduit 44. A blower 46 can be fluidly coupled to the exhaust conduit 44. The blower 46 can be operably coupled to and controlled by the controller 14. Operation of the blower 46 draws air into the treating chamber 34 as well as exhausts air from the treating chamber 34 through the exhaust conduit 44. The exhaust conduit 44 can be fluidly coupled with a household exhaust duct (not shown) for exhausting the air from the treating chamber 34 to the outside of the clothes dryer 10.

The air system can further include various sensors and other components, such as at least one thermistor, or an inlet thermistor 47 and a thermostat 48, which can be coupled to the supply conduit 38 in which the heating element 42 can be positioned. The inlet thermistor 47 and the thermostat 48 can be operably coupled to each other. Alternatively, the inlet thermistor 47 can be coupled to the supply conduit 38 at or near to the inlet grill 40. Regardless of its location, the inlet thermistor 47 can be used to aid in determining an inlet temperature (IT) of air entering the treating chamber 34. Another thermistor, or outlet thermistor 51 and a thermal fuse 49 can be coupled to the exhaust conduit 44 proximate an air outlet 53 of the treating chamber 34, with the outlet thermistor 51 being used to determine an outlet temperature (OT) of air exiting the treating chamber. Alternatively, the outlet thermistor 47 can be coupled to the exhaust conduit 44 at or near to the lint trap 45.

A first conductivity sensor 50 can be positioned in the interior of the treating chamber 34 to monitor the amount of moisture of the laundry in the treating chamber 34. The first conductivity sensor 52 can be located at the front of the treating chamber 34 at a bottom portion of the front wall 31 of the drum 28. It is also contemplated that the first conductivity sensor 50 can be integrated with the lint trap 45 or at any location in the interior of the dispensing dryer 10 such that the first conductivity 50 can accurately sense the moisture content of the laundry. A second conductivity sensor 52 can be mounted at the rear of the treating chamber 34, for example, on the real wall 35 of the drum 28 as illustrated. The conductivity sensors 50, 52 can be operably coupled to the controller 14 such that the controller 14 receives output from the conductivity sensors 50, 52. While two conductivity sensors 50, 52 are illustrated, this is not meant to be limiting and other configurations can be contemplated.

Each conductivity sensor 50, 52 is normally two, spaced strips of metal forming part of an electrical circuit such that when a laundry item touches both strips it closes the circuit, which lets an electrical signal pass through, which is registered as a "hit". The circuit is coupled to the controller 14, which can monitor/analyze the frequency and duration of the hits over time to assess the dryness of the load. As the load dries, the frequency and duration will lessen as dry laundry is not as conductive as wet laundry.

The determination of a "dry" load can be based on the moisture content of the laundry, which may be set by the user based on the selected cycle, an option to the selected cycle, or a user-defined preference. The moisture content can be determined using a single moisture sensor, such as a conductivity sensor, located at the front of the treating chamber. The conductivity sensor can be used to calculate a projected drying time. In exemplary implementations, the conductivity sensors are not used for an absolute determination of dryness because they may not be accurate below approximately 10% moisture content and a load (at least in certain exemplary implementations) is typically not considered dry unless it has less than 5% moisture content or, more typically, 2-4%. Thus, the output of the conductivity sensor is used to calculate a drying time that is expected to have less than 5% moisture content.

Together the inlet and outlet thermistors 47, 51 can provide a thermal signal for an end of cycle estimation when either a signal from the conductivity sensors is no longer being produced because all of the laundry is wet, or an error has occurred. Additionally, when the dryness level drops below 10% a thermal signal from the inlet and outlet thermistors 47, 51 can be utilized to determine an end of cycle estimation time.

Together the inlet and outlet thermistors 47, 51 along with the first and second conductivity sensors 50, 52 can provide information as a single model to the controller 14. The single model can use information from the inlet and outlet thermistors 47, 51 to determine the temperature differential between incoming and outgoing air. This information can be in addition to or compared with the moisture content of the laundry sensed by the first and second conductivity sensors. These four pieces of input can together form the single model necessary for determining an end of cycle for the clothes dryer 10.

A dispensing system 57 can be provided for the clothes dryer 10 to dispense one or more treating chemistries to the treating chamber 34 according to a cycle of operation. As illustrated, the dispensing system 57 can be located in the interior of the cabinet 12 although other locations are also possible. The dispensing system 57 can be fluidly coupled to a water supply 68. The dispensing system 57 can be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible.

As illustrated, the dispensing system 57 can include a reservoir 60, which can be a cartridge, for a treating chemistry that is releasably coupled to the dispensing system 57, which dispenses the treating chemistry from the reservoir 60 to the treating chamber 34. The reservoir 60 can include one or more cartridges configured to store one or more treating chemistries in the interior of cartridges. A suitable cartridge system can be found in U.S. Pub. No. 20150240407 to Hendrickson et al., filed Apr. 28, 2015, now U.S. Pat. No. 9,920,468, issued Mar. 20, 2018, entitled "Method for Converting a Household Cleaning Appliance with a Non-Bulk Dispensing System to a Household Cleaning Appliance with a Bulk Dispensing System," which is herein incorporated by reference in its entirety.

A mixing chamber 62 can be provided to couple the reservoir 60 to the treating chamber 34 through a supply conduit 63. Pumps such as a metering pump 64 and a delivery pump 66 can be provided to the dispensing system 57 to selectively supply a treating chemistry and/or liquid to the treating chamber 34 according to a cycle of operation. The water supply 68 can be fluidly coupled to the mixing chamber 62 to provide water from the water source to the mixing chamber 62. The water supply 68 can include an inlet valve 70 and a water supply conduit 72. It is noted that, instead of water, a different treating chemistry can be provided from the exterior of the clothes dryer 10 to the mixing chamber 62.

The treating chemistry can be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 can also be provided with a steam generating system 80 which can be separate from the dispensing system 57 or integrated with portions of the dispensing system 57 for dispensing steam and/or liquid to the treating chamber 34 according to a cycle of operation. The steam generating system 80 can include a steam generator 82 fluidly coupled with the water supply 68 through a steam inlet conduit 84. A fluid control valve 85 can be used to control the flow of water from the water supply conduit 72 between the steam generating system 80 and the dispensing system 57. The steam generator 82 can further be fluidly coupled with the one or more supply conduits 63 through a steam supply conduit 86 to deliver steam to the treating chamber 34 through the nozzles 69. Alternatively, the steam generator 82 can be coupled with the treating chamber 34 through one or more conduits and nozzles independently of the dispensing system 57.

The steam generator 82 can be any type of device that converts the supplied liquid to steam. For example, the steam generator 82 can be a tank-type steam generator that stores a volume of liquid and heats the volume of liquid to convert the liquid to steam. Alternatively, the steam generator 82 can be an in-line steam generator that converts the liquid to steam as the liquid flows through the steam generator 82.

It will be understood that any suitable dispensing system and/or steam generating system can be used with the dryer 10. It is also within the scope of the invention for the dryer 10 to not include a dispensing system or a steam generating system.

Figure 2:
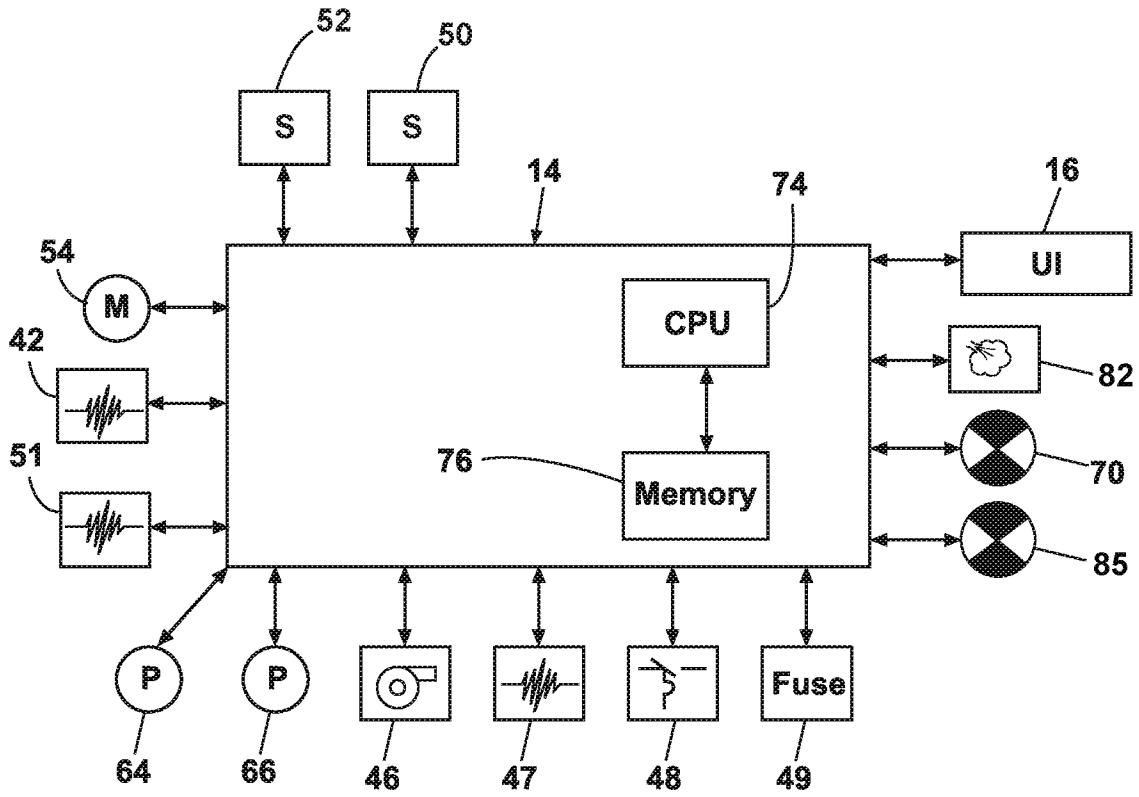
FIG. 2 is a schematic view of a controller for the clothes dryer in FIG. 1.

FIG. 2 is a schematic view of the controller 14 coupled to the various components of the dryer 10. The controller 14 can be communicably coupled to components of the clothes dryer 10 such as the heating element 42, blower 46, inlet thermistor 47, thermostat 48, thermal fuse 49, outlet thermistor 51, first and second conductivity sensor 50, 52, motor 54, inlet valve 70, pumps 64, 66, steam generator 82 and fluid control valve 85 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 can be provided with operational controls such as dials, lights, knobs, levers, buttons, switches, and displays enabling the user to input commands to a controller 14 and receive information about a treatment cycle from components in the clothes dryer 10 or via input by the user through the user interface 16. The user can enter many different types of information, including, without limitation, cycle selection and cycle parameters, such as cycle options. Any suitable cycle can be used. Non-limiting examples include, Casual, Delicate, Super Delicate, Heavy Duty, Normal Dry, Damp Dry, Sanitize, Quick Dry, Timed Dry, and Jeans.

The controller 14 can implement a treatment cycle selected by the user according to any options selected by the user and provide related information to the user. The controller 14 can also comprise a central processing unit (CPU) 74 and an associated memory 76 where various treatment cycles and associated data, such as look-up tables, can be stored. One or more software applications, such as an arrangement of executable commands/instructions can be stored in the memory and executed by the CPU 74 to implement the one or more treatment cycles.

In general, the controller 14 will effect a cycle of operation to effect a treating of the laundry in the treating chamber 34, which can or cannot include drying. The controller 14 can actuate the blower 46 to draw an inlet air flow 58 into the supply conduit 38 through the rear vent 37 when air flow is needed for a selected treating cycle. The controller 14 can activate the heating element 42 to heat the inlet air flow 58 as it passes over the heating element 42, with the heated air 59 being supplied to the treating chamber 34. The heated air 59 can be in contact with the main laundry load 36 as it passes through the treating chamber 34 on its way to the exhaust conduit 44 to effect a moisture removal of the laundry. The heated air 59 can exit the treating chamber 34, and flow through the blower 46 and the exhaust conduit 44 to the outside of the clothes dryer 10. The controller 14 continues the cycle of operation until completed. If the cycle of operation includes drying, the controller 14 determines when the laundry is dry. The determination of a "dry" load can be made in different ways, but is often based on the moisture content of the laundry, which is typically set by the user based on the selected cycle, an option to the selected cycle, or a user-defined preference.

During a cycle of operation, one or more treating chemistries can be provided to the treating chamber 34 by the dispensing system 57 as actuated by the controller 14. To dispense the treating chemistry, the metering pump 64 is actuated by the controller 14 to pump a predetermined quantity of the treating chemistry stored in the reservoir 60 to the mixing chamber 62, which can be provided as a single charge, multiple charges, or at a predetermined rate, for example. The treating chemistry can be in the form of a gas, liquid, solid, gel or any combination thereof, and can have any chemical composition enabling refreshment, disinfection, whitening, brightening, increased softness, reduced odor, reduced wrinkling, stain repellency or any other desired treatment of the laundry. The treating chemistry can be composed of a single chemical, a mixture of chemicals, or a solution of a solvent, such as water, and one or more chemicals.

Figure 3B:
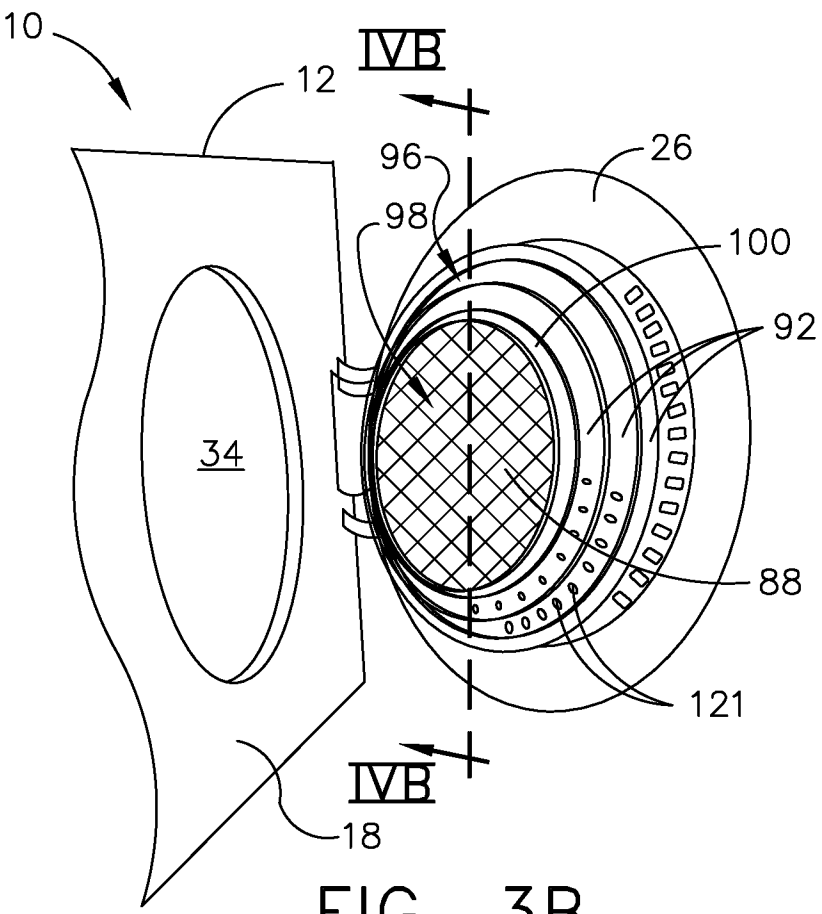
FIG. 3B is a perspective view of the separate container from FIG. 3A in a second position.
Figure 3A:
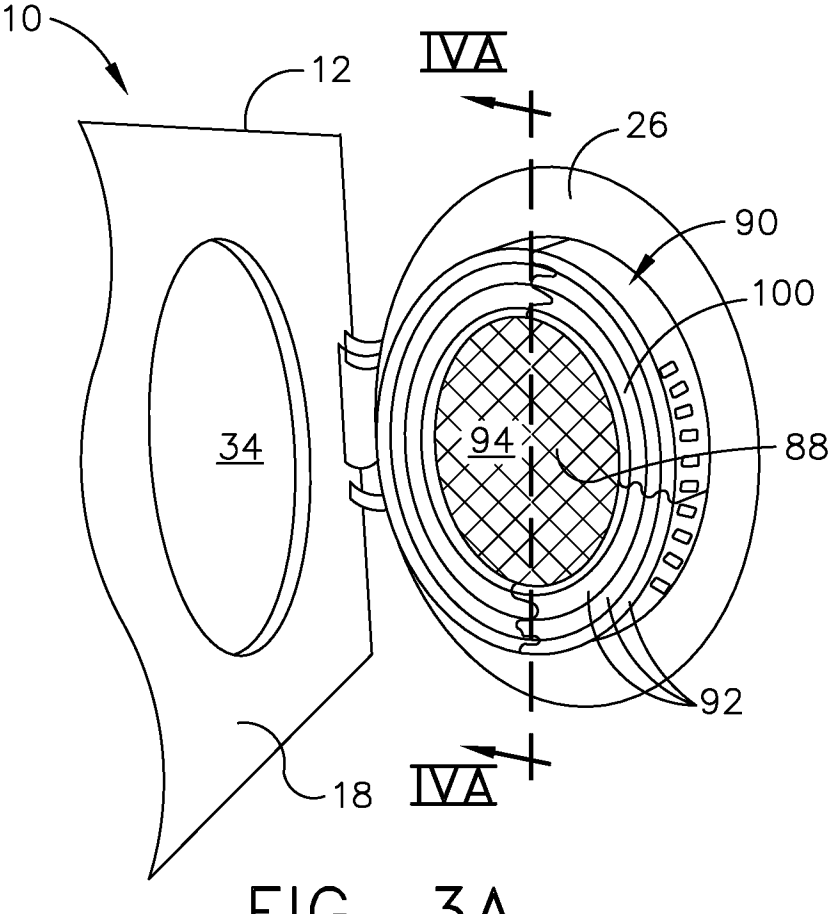
FIG. 3A is a perspective view of a door for the clothes dryer in FIG. 1 with a separate container coupled to the door in a first position according to an aspect of the disclosure.

Turning to FIG. 3A, a perspective view of the clothes dryer 10 illustrates a separate container 88 coupled to the door 26 in a first position 90. It is further contemplated that the separate container 88 can be mounted at the rear of the treating chamber 34. The first position 90 can be a collapsed position or stowed position in which portions, by way of non-limiting example multiple, illustrated as three, concentric ring portions 92, are received within each other. While illustrated as concentric rings, the concentric ring portions 92 are not so limited and can be any shape, by way of non-limiting example concentric ovals, squares, rectangles, or the like. The first position 90 can be characterized with the separate container 88 being relatively flat with respect to the door 26.

The separate container 88 can include a screen face 94 made of a mesh material for containment of laundry items within the separate container 88 and through which air from the treating chamber 34 can still move freely. The separate container 88 can be formed from sufficiently pliable materials, such as thermoplastic elastomer (TPE), thermoplastic vulcanizate (TPV), or rubber silicone that can also withstand high temperatures.

In FIG. 3B, the separate container 88 is illustrated in a second position 96. The second position can be an expanded or treatment position in which portions, by way of non-limiting example the three concentric ring portions 92, are expanded out to form a secondary treating chamber 98. It is further contemplated that the concentric ring portions 92 are molded from a flexible, elastomeric, perforated membrane 99 forming a collapsible basket 100 having at least one vent opening 121. Laundry items not suitable for normal drying cycles within the treating chamber 34 can be placed in the secondary treating chamber 98 for drying.

Figure 4B:
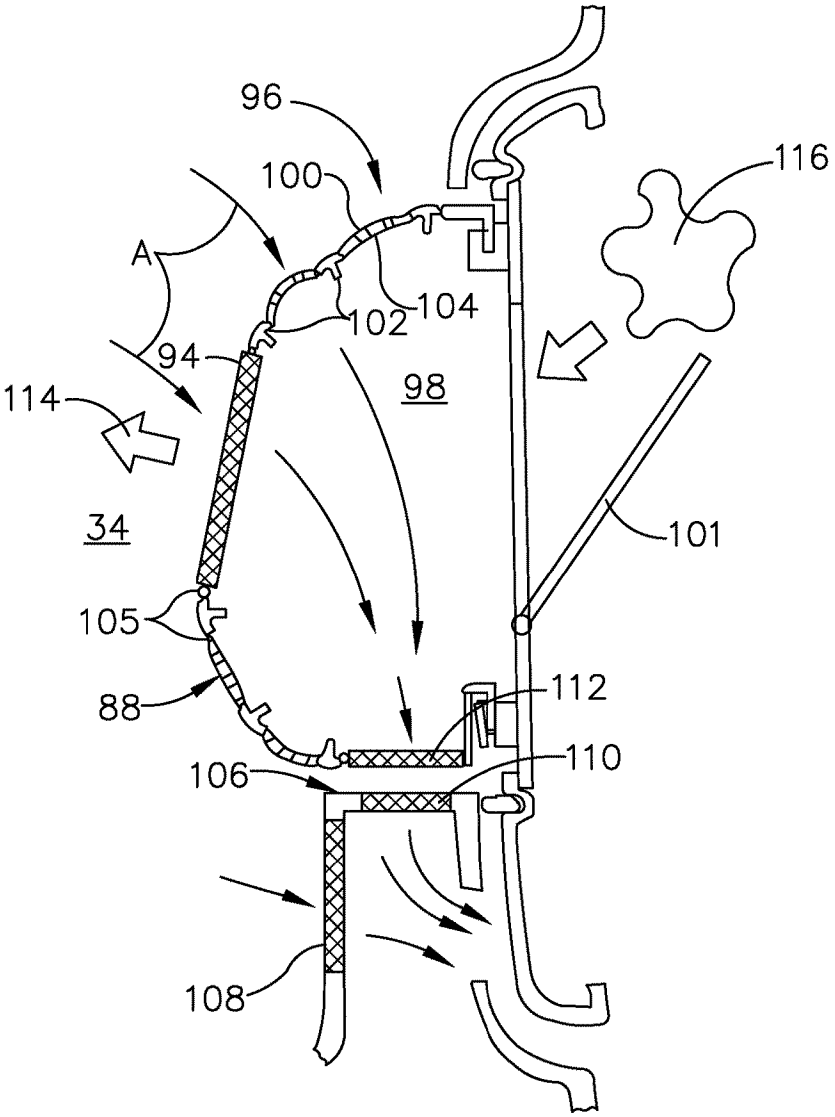
FIG. 4B is a cross-sectional side view of the separate container from FIG. 3B.
Figure 4A:
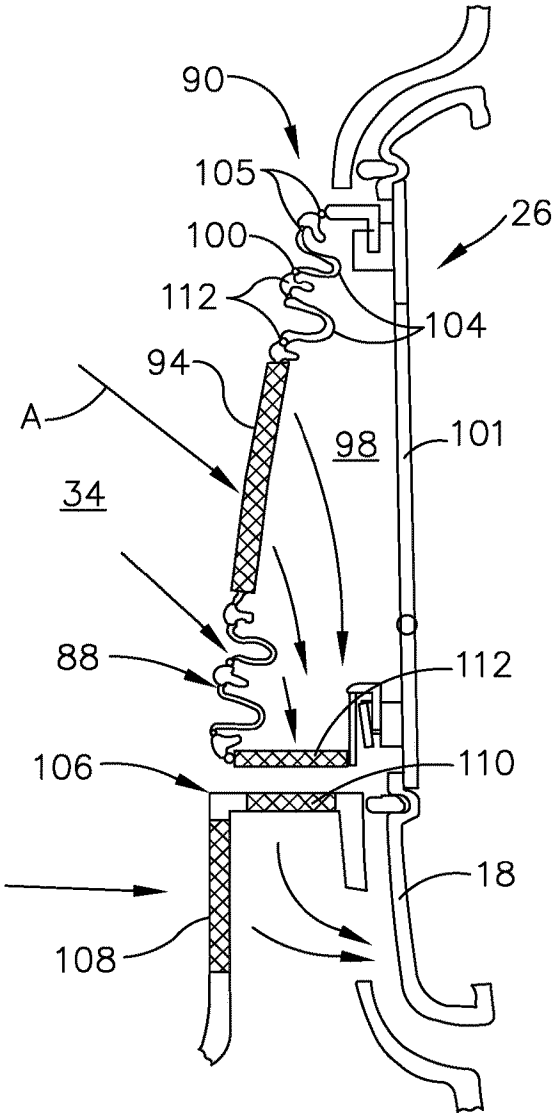
FIG. 4A is a cross-sectional side view of the separate container from FIG. 3A.

FIG. 4A illustrates a cross-sectional view of the separate container 88 in the first position 90 as viewed along line IV-IV from FIG. 3A. It can more clearly be seen that the collapsible basket 100 can include stiffening rings 102, by way of non-limiting example six stiffening rings, coupled to consecutive pliable portions 104, forming the perforated membrane 99. Each stiffening ring 102 can be mounted to the pliable portions 104 via hinges 105 on opposing sides of the stiffening ring 102. The stiffening ring 102 can be formed from polypropylene another thermoplastic, or a metal such as stainless steel. The stiffening ring 102 and pliable portions 104 can be coupled in the manufacturing process via 2-shot injection over molding or insert molding. It is further contemplated that while illustrated as separate pliable portions 104, the collapsible basket 100 can be a single continuous piece of rubber silicone, TPE, TPV or the like. A basket door 101 can be hingedly mounted to the front of door 26 such that access to the second treating chamber is possible without opening the dyer door 26 to gain access to the treating chamber 34.

A dryer vent 106 can be provided proximate the door 26 at a lower portion of the front wall 18. The dryer vent 106 can include a main vent 108 and a secondary vent 110. The main vent 108 can be directly fluidly coupled to the treating chamber 34. A portion of the collapsible basket 100 can overly the secondary vent 110 such that a basket vent 112 faces the secondary vent 110 when the collapsible basket is in the first position 90.

During a drying cycle when the collapsible basket is stowed, or in the first position 90, circulating air (A) within the treating chamber 34 can pass through the screen face 94, through the basket vent 112, and through the secondary vent 110. Circulating air (A) can also pass directly into the drying vent 106 via the main vent 108. In this manner, a drying cycle in which the second treating chamber 98 is not in use can cycle normally.

FIG. 4B illustrates a cross-sectional view of the separate container 88 in the second position 96 as viewed along line IV-IV from FIG. 3B. In the expanded, or second position 96, the collapsible basket 100 has been pulled out toward the treating chamber 34 in a direction indicated by arrow 114. A second laundry load 116 can be received within the second treating chamber 98 through the basket door 101. The second laundry load 116 can be any item not suitable for tumble drying within the treating chamber 34. By way of non-limiting example laundry items designated as the second laundry load 116 can include but are not limited to delicates, undergarments, and shoes.

In the second position 96, the basket vent 112 remains opposite the secondary vent 110. The circulating air (A) can pass through the screen face 94 and come into contact with items defining the second laundry load 116 during operation. The circulating air (A) can then pass through the basket vent 112 and secondary vent 110 as illustrated. The vents 112, 110 can be formed from a rigid thermoplastic or metal rotatably fixed to the collapsible basket 100. When in the second position 96 the secondary vent can be folded down and serve as a stop maintaining the container in the expanded second position 96. The secondary vent 110 can be relatively flat and wide substantially filling the width and depth of the container and act as a shelf or separator while it is in the second position 96. Multiple holes ensure adequate airflow.

Figure 5B:
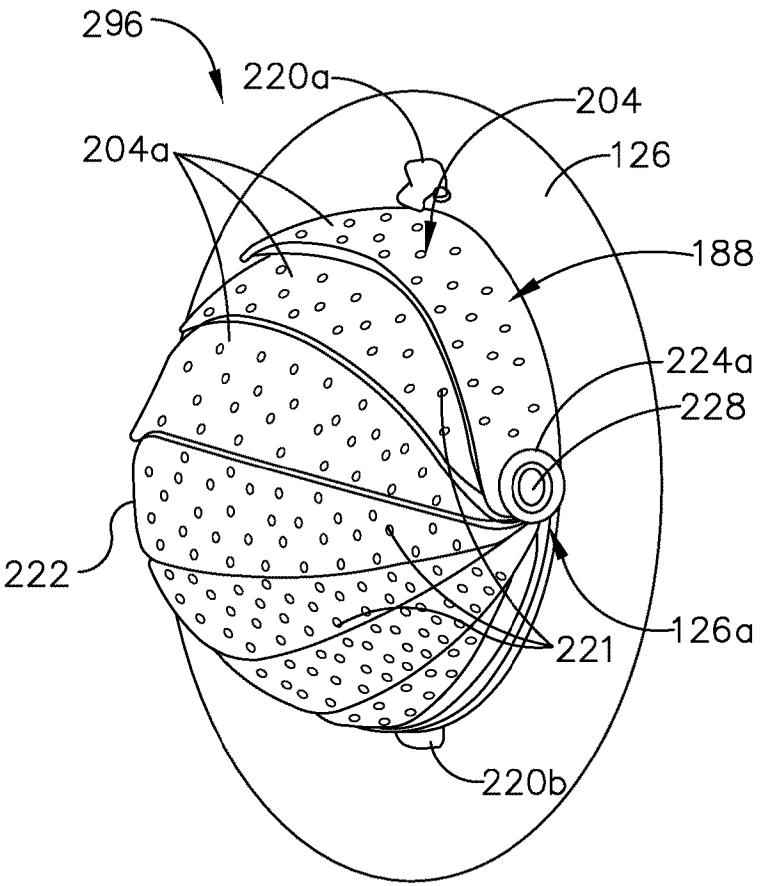
FIG. 5B is a perspective view of the separate container from FIG. 5A in a second position.
Figure 5A:
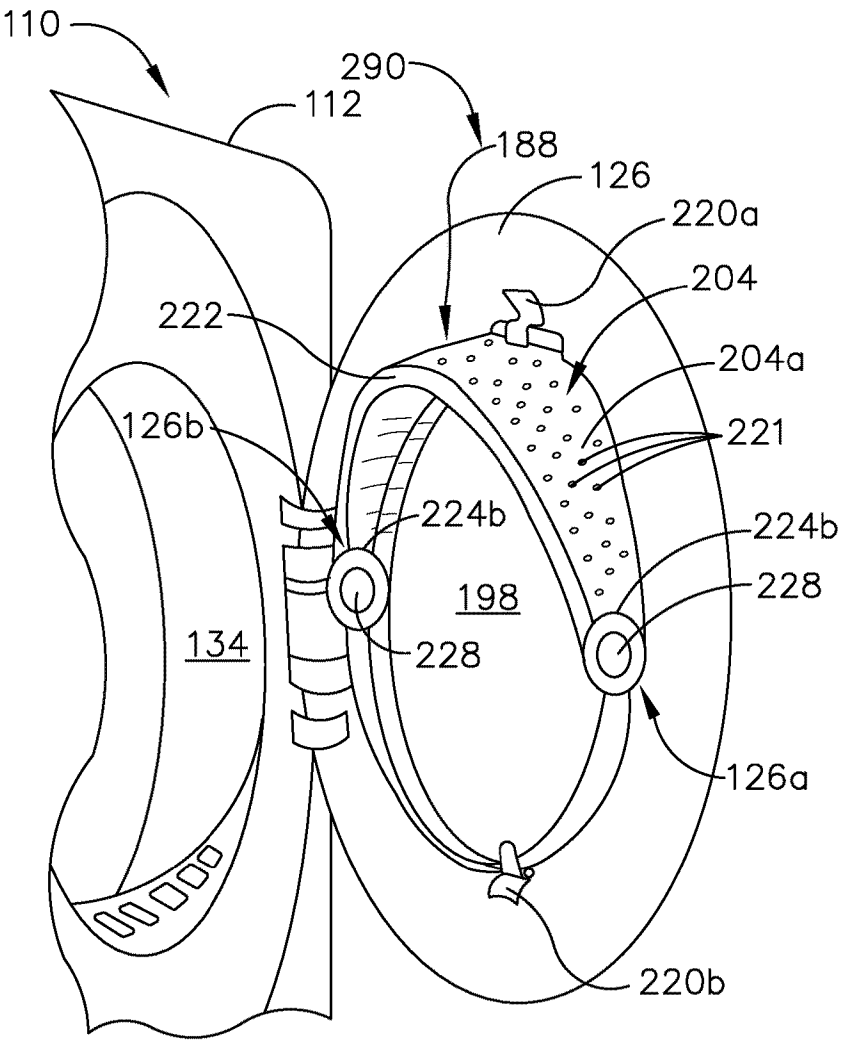
FIG. 5A is a perspective view of a door for the clothes dryer in FIG. 1 with a separate container coupled to the door in a first position according to another aspect of the disclosure discussed herein.

FIG. 5A is a separate container 188 according to another aspect of the disclosure discussed herein. The separate container 188 is substantially similar to the separate container 88 of FIG. 3A. Therefore, like parts will be identified with like numerals increased by 100, with it being understood that the description of the like parts of the separate container 88 applies to the separate container 188 unless otherwise noted.

Separate container 188 is illustrated in a first position 190 where a set of retractable panel portions 204 are in a stowed position 218 held in place with, by way of non-limiting example a first clasp 220*a* located near the top 125*a* of dryer door 126. It is further contemplated that the first position 190 can be defined as the set of retractable panel portions 204 in the stowed position 218 proximate the bottom 125*b* or sides 126*a*, 126*b* of the dryer door 126. The top 125*a* as the location for the stowed position 218 is for illustrative purposes only and not meant to be limiting. A second clasp 220*b* is located at the bottom 125*b* of dryer door 126 such that when pulled into a second position 196 (FIG. 5B) the set of retractable panel portions 204 define a second treating chamber 198.

The set of panel portions 204 is made up of individual panel portions 204*a* each of which can include vent openings 221. Each individual panel portion 204*a* can be semi-circular such that each panel portion 204*a* follows the contour of the dryer door 126. Each individual panel portion 204*a* can define a wider portion at a center 222 and taper to narrow portions defining opposing ends 224*a*, 224*b*. The opposing ends 224*a*, 224*b* can be rotatably mounted at opposing sides 126*a*, 126*b* of the dryer door 126 with, by way of non-limiting example, a torque hinge 228.

FIG. 5B illustrates separate container 188 in the second position 196. The set of retractable panels 204 when expanded forms a half sphere shape. Though illustrated as half of a sphere, different shapes are also contemplated. The half sphere shape is formed from individual panel portions 204*a* that are consecutively smaller in size. In this manner, the individual panel portions 204*a* can be received within each other and stowed as illustrated in FIG. 5A. The smallest of the individual panel portions 204*a* is received by the second clasp 220*b* at a bottom 225*b* of the dryer door 126 where it can be, by way of non-limiting example, snapped into place. Vent openings 221 enable circulating air to flow through the individual panel portions 204*a* when in operation.

Figure 6A:
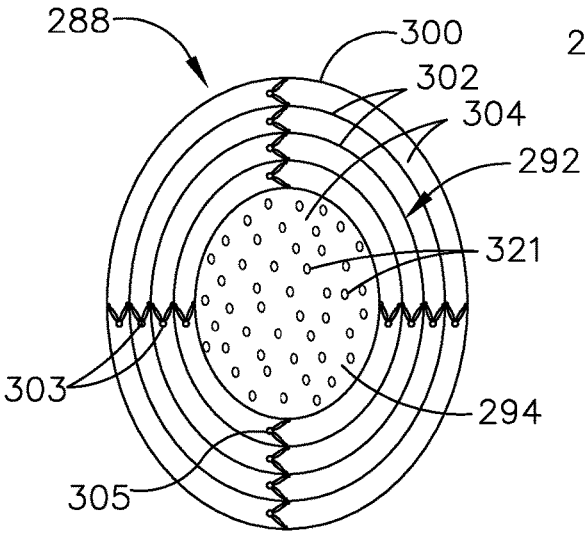
FIG. 6A is a front view of a separate container for the dryer of FIG. 1 in a first position according to another aspect of the disclosure discussed herein.

FIG. 6A is a separate container 288 according to another aspect of the disclosure discussed herein. The separate container 288 is substantially similar to the separate container 88 of FIG. 3A. Therefore, like parts will be identified with like numerals increased by 200, with it being understood that the description of the like parts of the separate container 88 applies to the separate container 288 unless otherwise noted. While the dryer door is not illustrated, like separate container 88, separate container 288 can be mounted to a dryer door.

FIG. 6A is a front view of the separate container 288 in a collapsed, or first position 290. The separate container 288 can be a collapsible basket 300 formed from concentric ring portions 292 formed from pliable portions 304. The concentric ring portions 292 can include at least one stiffening ring 302, illustrated as five consecutively smaller stiffening rings 302, coupling consecutive pliable portions 304 to each other. It is contemplated that the pliable portions 304 each include a central hinge 303 and are mounted to consecutive stiffening rings 302 at mounting hinges 305. It is further contemplated that the central hinge 303 and mounting hinges 305 are made of the same material as the pliable portions 304 and are bending points within the pliable portions 304. A perforated face 294 can be formed of the same flexible material as the pliable portions 304 and be centrally located with respect to the stiffening rings 302. The perforated face can include a plurality of vent openings 321.

Figure 6B:
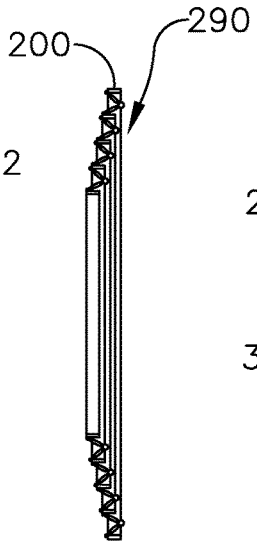
FIG. 6B is a side view of the separate container from FIG. 6A in a first position.

When in the first position 290, as illustrated in FIG. 6B, the collapsible basket 300 can become essentially flat. This can be the position for the collapsible basket 300 when not in use. The pliable portions 304 are folded with a fan fold at the central hinges 303 and received within consecutive stiffening rings 302.

Figure 6C:
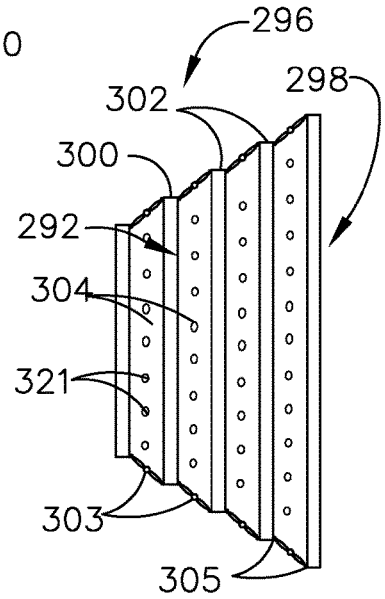
FIG. 6C is a side view of the separate container from FIG. 6A in a second position.

FIG. 6C illustrates the collapsible basket 300 in a second position 296, where the collapsible basket 300 is expanded to define a second treating chamber 298. In the second position 296, the second treating chamber 298 can receive a second laundry load (not shown) as described herein. Vent openings 321 can also be provided on the pliable portions 304 to enable air circulation.

Figure 7A:
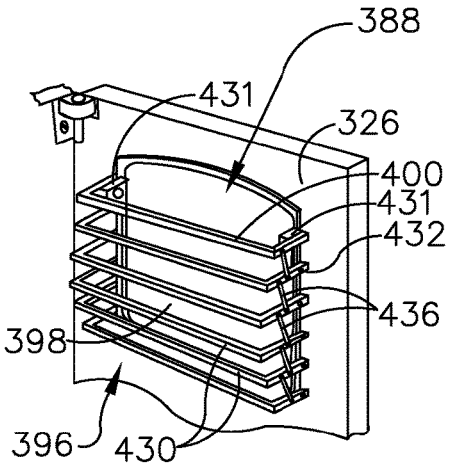
FIG. 7A is a perspective view of a separate container for the dryer of FIG. 1 in a second position according to another aspect of the disclosure discussed herein.

In yet another aspect of the disclosure herein, FIG. 7A is a separate container 388 substantially similar to the separate container 88 of FIG. 3A. Therefore, like parts will be identified with like numerals increased by 300, with it being understood that the description of the like parts of the separate container 88 applies to the separate container 388 unless otherwise noted.

A perspective view of the separate container 388 shows a collapsible basket 300 having lateral frames 430 where when locked in place via a locking mechanism 431 form a second treating chamber 398. The locking mechanism 431 can extend parallel to and along the same plane as the lateral frames 430 when in place. It is contemplated that the locking mechanism 431 can be located anywhere along the door and is depicted proximate the dryer door top 425*a* for illustrative purposes and is not meant to be limited.

Figure 7B:
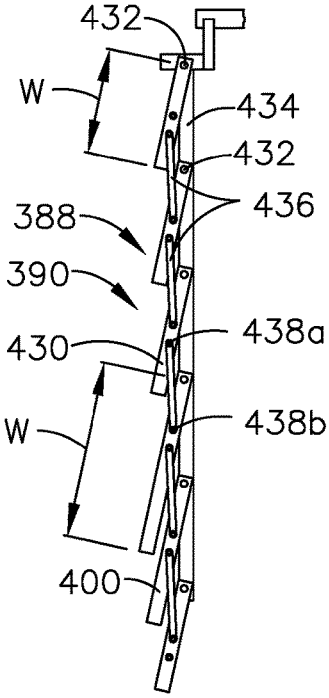
FIG. 7B is a side view of the separate container from FIG. 7A in a first position.

The separate container 388 can form the collapsible basket 300 where when in a first position 390, as illustrated in FIG. 7B, lateral frames 430 are oriented in a substantially vertical position. The lateral frames 430 are hung at regular intervals from a first end 432 mounted to a stationary vertical frame 434, much like louvers for window blinds. The lateral frames 430 can be of varying width (W) and fold onto each other via connecting hinges 436 mounted at first and second ends 438*a*, 438*b* to consecutive lateral frames 430.

To retain the lateral frames 430 in a vertical or horizontal position, a retaining member, rotatably fixed to the top or bottom of the door 326 can be provided. This feature, while not illustrated, can be similar to the clasp 220*b* in FIG. 5A. It is further contemplated that the retaining member can be a similar in nature to a kickstand, and rotate out to retain the collapsible basket 300 in the first and second positions 390, 396.

Figure 7C:
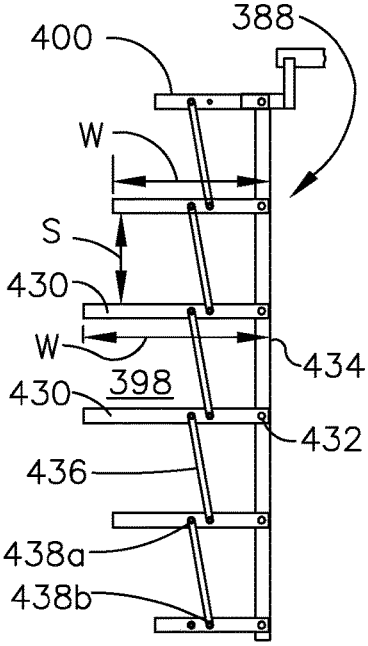
FIG. 7C is a side view of the separate container from FIG. 7A.

When in a second position 396 as illustrated in FIG. 7C, the lateral frames 430 are oriented in a substantially horizontal configuration to define a second treating chamber 398. Space (S) between the lateral frames 430 can vary and serve to allow circulating air (A) into the second treating chamber 398. When in use, the second treating chamber 398 can hold a second load of laundry (not shown) for drying.

Figure 8B:
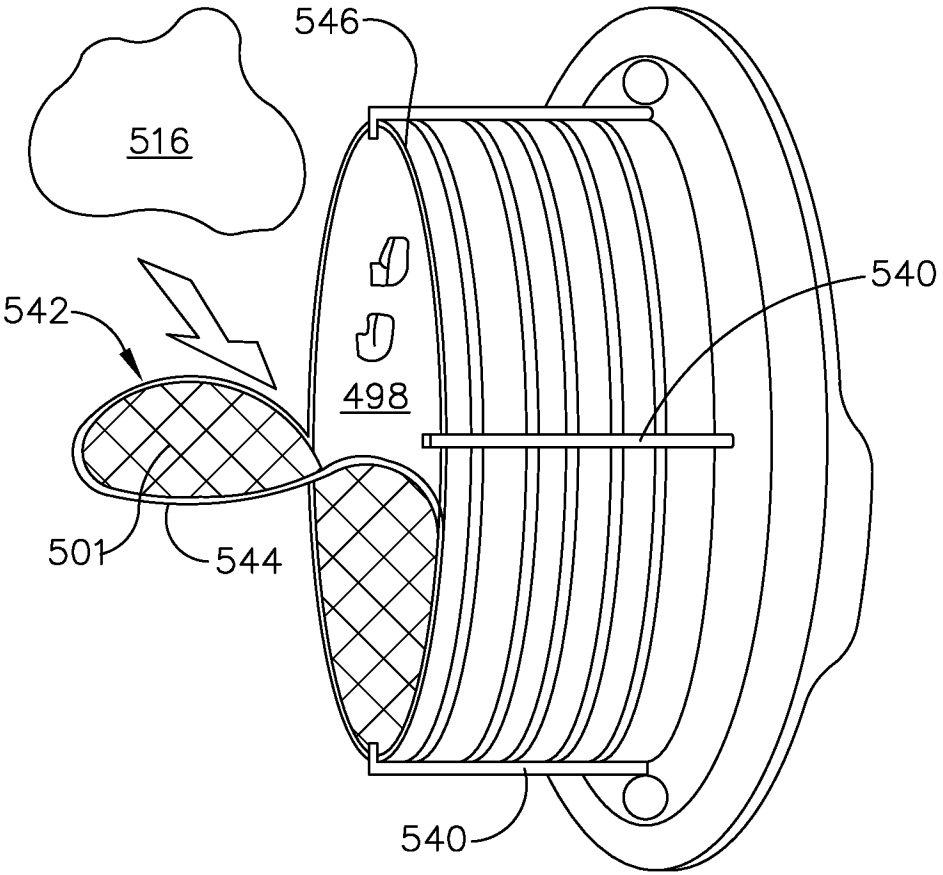
FIG. 8B is a perspective view of the separate container from FIG. 8A in another aspect of the disclosure discussed herein.
Figure 8A:
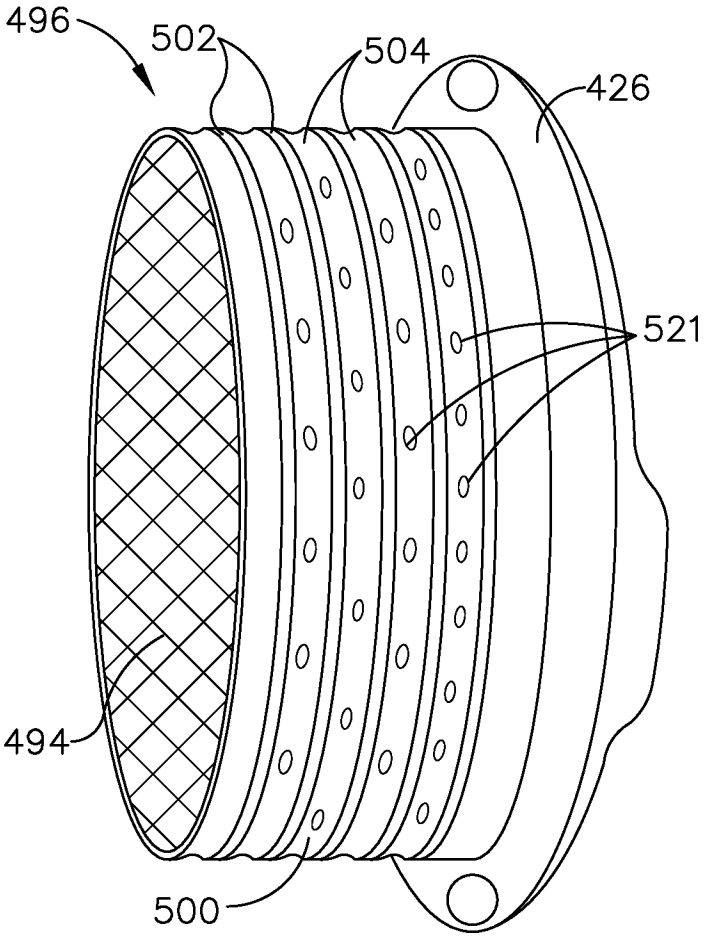
FIG. 8A is a perspective view of a separate container for the dryer of FIG. 1 according to yet another aspect of the disclosure discussed herein.

In still another aspect of the disclosure herein, FIG. 8A is a separate container 488 substantially similar to the separate container 88 of FIG. 3A. Therefore, like parts will be identified with like numerals increased by 400, with it being understood that the description of the like parts of the separate container 88 applies to the separate container 488 unless otherwise noted.

Separate container 488 is illustrated in a second position 496, or expanded position as described herein. The first position (not shown) is much like the first position of the separate containers 188, 288 as illustrated in FIG. 3A and FIG. 6B respectively. Unlike separate container 288, separate container 488 is a cylindrical shape defining a second treating chamber 498. The separate container 488 can extend straight out from a dryer door 426 and terminate in a screen face 494. The separate container 488 can be a collapsible basket 500 formed from stiffening rings 502 and pliable portions 504 much like the collapsible baskets already discussed herein. Unlike the collapsible baskets discussed herein, collapsible basket 500 does not have concentric ring portions, instead, stiffening rings 502 can be formed from an internal coil spring that in one aspect of the disclosure can be pushed to spring open into the second position 496 as illustrated.

The screen face 494 can double as a vent and a basket door 501 as illustrated in FIG. 8B. The screen face 494 can include a snap fit 542 where one of the screen face 494 or collapsible basket 500 includes a first member 544 formed to snap onto a second member 546 on the other of the screen face 494 or collapsible basket 500. A secondary laundry load 416 can be received within the second treating chamber 498 through the basket door 501.

In another aspect of the disclosure discussed herein and illustrated in FIG. 8B, the stiffening rings 502 can be sprung closed. The stiffening rings 502 can be formed from a coiled spring where when at rest remains compressed. In order to move to the second position 496, the collapsible basket 500, must therefore be pulled open. By way of non-limiting example hinged rods 540 can be utilized to pull the collapsible basket 500 to the second position 496. When in an extended position as illustrated, the hinged rods 540 can click into place to become rigid and provide a framework for the collapsible basket 500. The hinged rods 540 are depicted for illustrative purposes only and not meant to be limiting. Any sufficient structure within or along an exterior of the collapsible basket 500 for extending the basket into the second position 496 as illustrated is contemplated.

Figure 9:
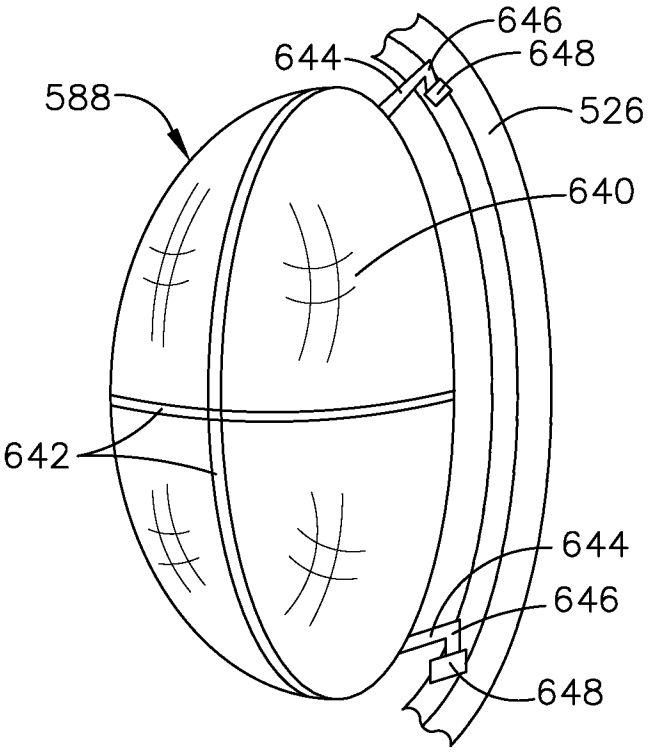
FIG. 9 is a perspective view of a separate container for the dryer of FIG. 1 according to yet another aspect of the disclosure discussed herein where the separate container can be mounted to the dryer via at least one coupler.

A separate container 588 substantially similar to the separate container 88 of FIG. 3A is illustrated in FIG. 9. Therefore, like parts will be identified with like numerals increased by 500, with it being understood that the description of the like parts of the separate container 88 applies to the separate container 588 unless otherwise noted.

The separate container 588 can include a rigid mesh face 640. The rigid mesh face 640 can be reinforced by semicircular framing 642 extending in both a generally vertical and horizontal direction. The rigid mesh face 640 can be a metal mesh or polymer mesh. It is contemplated that the separate container 588 is sufficiently rigid and formed to detach from a dryer door 526 when not in use as one piece. The separate container 588 can be, by way of non-limiting example, snapped into place.

In another aspect of the disclosure herein, the separate container 588 can include mounting arms 644 terminating in L-shaped ends 646. By way of non-limiting example two mounting arms 644 are illustrated. The L-shaped ends 646 can be used to mount the separate container 588 to the dryer door via at least one coupler 648, illustrated as two couplers.

Figure 10:
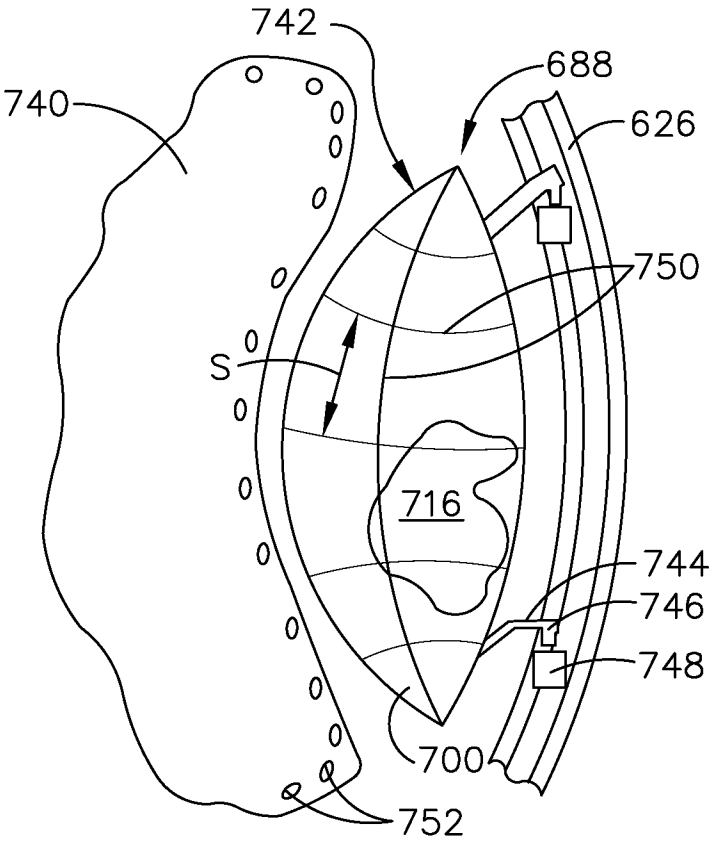
FIG. 10 is a perspective view of a separate container for the dryer of FIG. 1 according to another aspect of the disclosure discussed herein where the separate container can be mounted to the dryer via at least one coupler.

A separate container 688 is further contemplated as depicted in FIG. 10. Like parts are identified with like numerals increased by 600 with it being understood that the description of the like parts of the separate container 88 applies to the separate container 688 unless otherwise noted. The separate container 688 includes a rigid framework 742 over which a mesh bag 740 can be applied. The rigid frame work 742 can be formed from frame components 750 spaced (S) such that a second laundry load 716 can be received within the separate container 688 without the use of a door or the like. It is also contemplated that a second laundry load 716 is placed within the separate container 688 prior to mounting the second container 688 to a dryer door 626 as illustrated. The mesh bag 740 can be, by way of non-limiting example snapped to the rigid framework 742 via snaps 752, or coupled to the rigid frame work 742 in any suitable way.

Figure 11:
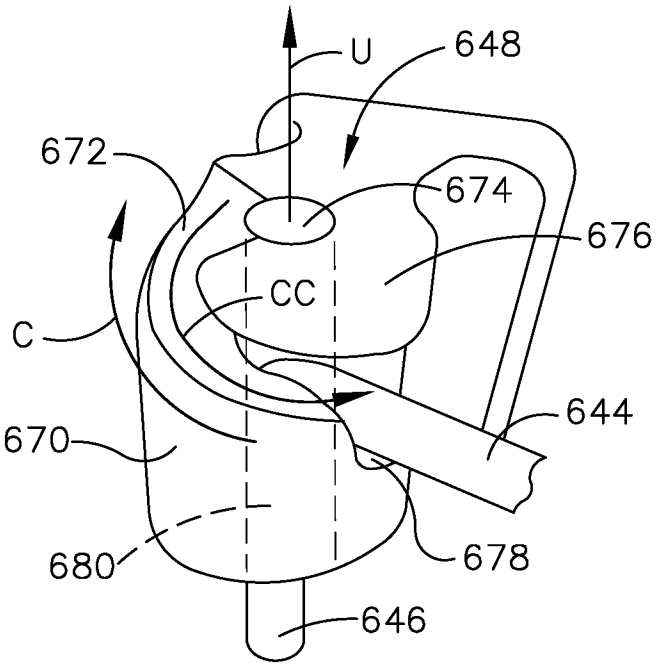
FIG. 11 is a perspective view of a coupler, which can be the at least one coupler in FIG. 9 or FIG. 10 according to an aspect of the disclosure discussed herein.

FIG. 11 is an enlarged view of the at least one coupler 648. The coupler 648 can extend vertically to define a substantially cylindrical body 670. A vertically extending quarter turn ramp 672 extends from an opening 674 at a top 676 of the cylindrical body 670 to a notch opening 678 at an interior 680 of the cylindrical body 670. The L-shaped end 646 can be received at the opening 674 and upon turning the mounting arm 644, by way of non-limiting example in a counterclockwise direction as indicated by arrow (CC), can lock into place at the notch opening 678 with the L-shaped end 646 being received within the interior 680. To remove, the mounting arm 644 can be turned, by way of non-limiting example, in a clockwise direction as indicated by arrow (C), slide along the quarter turn ramp 672 until reaching the opening 674 at which point the mounting arm 644 can be lifted up (U) and the L-shaped end 646 removed from the opening 674.

Figure 12:
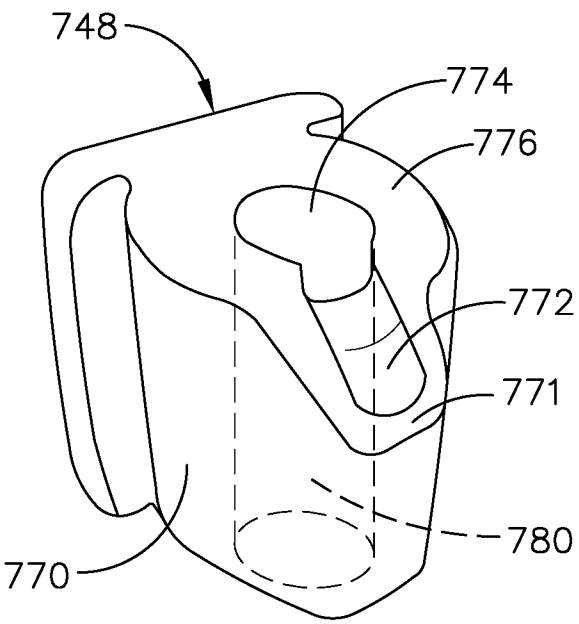
FIG. 12 is a perspective view of another coupler, which can be the at least one coupler in FIG. 9 or FIG. 10 according to another aspect of the disclosure discussed herein.

A coupler 748 substantially similar to the coupler 648 of FIG. 11 is illustrated in FIG. 12. Therefore, like parts will be identified with like numerals increased by 100, with it being understood that the description of the like parts of the coupler 648 applies to the coupler 748 unless otherwise noted.

The coupler 748 can extend vertically to define a substantially cylindrical body 770. A thickened portion 771 can extend from the cylindrical body 770. A vertically extending ramp 772 extends from an opening 774 at a top 776 of the cylindrical body 770 downward into the thickened portion 771. Much in the same way as described with the coupler 648, an L-shaped end 746 of a mounting arm 744 can slide up the vertically extending ramp 772 and slide into the opening 774.

The couplers 648, 748 as described herein can be used in conjunction or separately for mounting any one of the separate containers as described herein. It should be understood, that combinations of features of the separate containers as described herein is also contemplated, and that the disclosure as described herein is for illustrative purposes only and not meant to be limiting.

Figure 13:
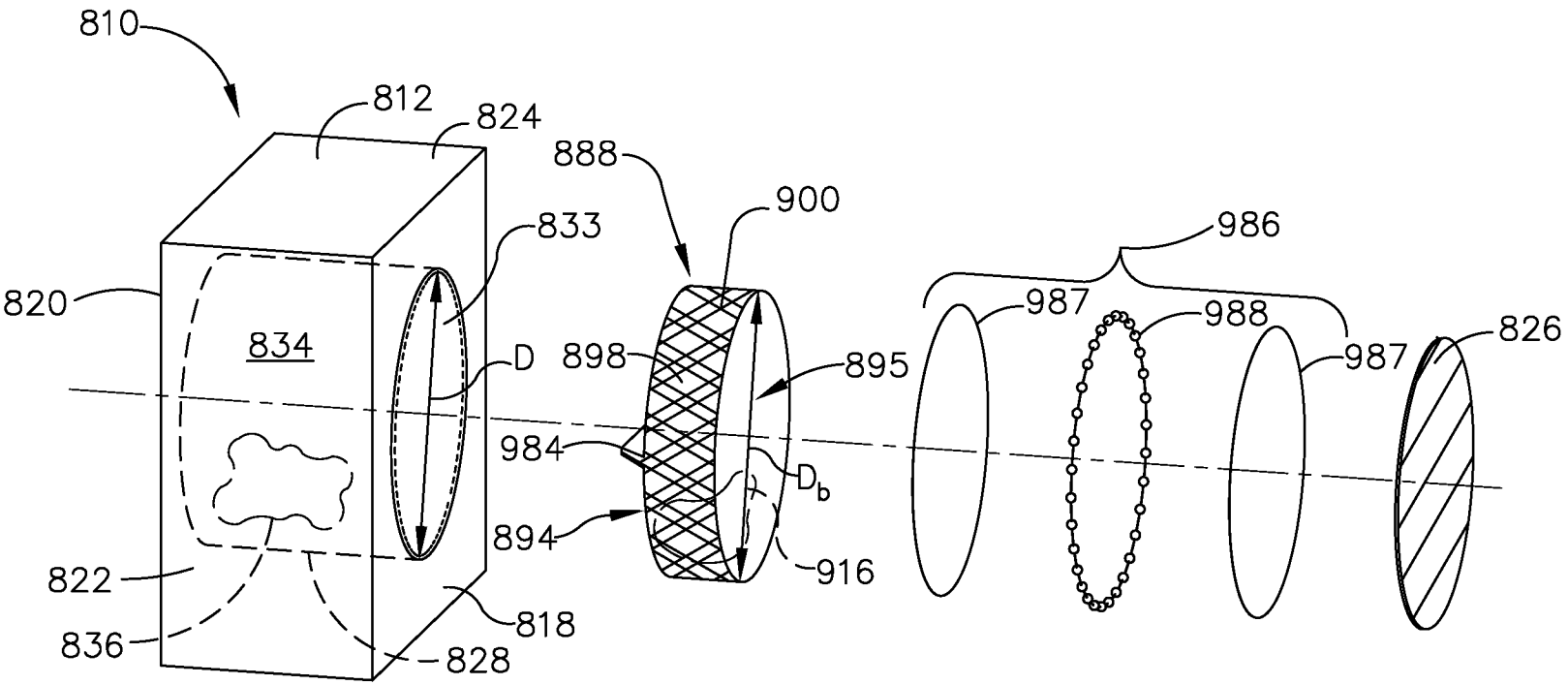
FIG. 13 is a perspective view exploded view of the dryer from FIG. 1 with a separate container according to yet another aspect of the disclosure discussed herein.

In yet another aspect of the disclosure described herein, a separate container 888 is illustrated in FIG. 13 as part of an exploded view of a clothes dryer 810. The separate container 888 is substantially similar to the separate container 88 of FIG. 3A. Therefore, like parts will be identified with like numerals increased by 100, with it being understood that the description of the like parts of the separate container 88 applies to the separate container 888 unless otherwise noted.

The clothes dryer 810 can include a cabinet 812 defined by a front wall 818, rear wall 820, and side walls 822 and enclosed by a top wall 824. The front wall 818 can have an open front 833 defining a dimension, by way of non-limiting example a diameter (D), opening into a drum 828 defining a treating chamber 834. The clothes dryer 810 can further include a dryer door 826 which can be mounted to the cabinet 812 in any suitable manner.

A separate container 888 can be, by way of non-limiting example a substantially circular shape having a basket diameter (Db) at least slightly smaller than the diameter (D) of the open front 833. The separate container 88 can define a mesh basket 900, which in some aspects of the disclosure discussed herein can be collapsible. The mesh basket 900 can have a mesh frame 940 enclosing a second treating chamber 898. The mesh basket 900 can extend from an interior face 894 to an exterior face 895. A turning blade 984 can extend from the interior face 894 and across the interior face 894 a length less than or equal to the basket diameter (Db). A set of bearings 986, by way of non-limiting example rings 987*a*, 987*b* and ball bearings 988, can mount to the exterior face 895 of the mesh basket 900.

In operation, the mesh basket 900 is received within the open front 833 and the set of bearings 986 can be provided between the dryer door 826 and the mesh basket 900 such that the mesh basket 900 is free to spin about a horizontal axis (H) extending through the center of the open front 833. The mesh basket 900 can spin independently of the rotating drum 828. A main laundry load 836 can be lifted and rotated within the drum 828 during operation. The main laundry load 836 can come in contact with the turning blade 984 causing the mesh basket 900 to rotate about the horizontal axis (H). In this manner, though the rotation of the mesh basket 900 depends on the rotation of the drum 828, the rate at which the drum 828 and the mesh basket 900 rotate are different from each other. While the drum 828 is mechanically coupled to a motor 54 (FIG. 1) and therefore mechanically rotated, the mesh basket 900 is passively rotated by way of the laundry load 836.

It is further contemplated that a twist timer 990 can be coupled with, by way of non-limiting example the exterior face 895 of the mesh basket 900. The twist timer 990 can be turned to unwind at a rate different than the rate at which the drum 828 rotates. The twist timer 990 can therefore rotate the mesh basket 900 at a rate that also differs from the rotation rate of the drum 828. A second laundry load 916 disposed within the second treating chamber 898 can be tumbled, but at a different rate than the laundry load 836 within the treating chamber 834. The rate at which the second laundry load 916 is tumbled can be a slower, or a gentler rate, than the rate at which the laundry load 836 is tumbled. This enables a drying cycle that can tumble two different loads at varying rates of rotation.

It should be understood that an additional shelf can be placed in any one of the separate containers described herein on which a pair of shoes can be placed or to serve as a separator for different laundry items. Furthermore, latches, hooks, clasps, and other features described herein can be any type of latch, hook, clasp, and are not limited by those illustrated.

Benefits associated with the embodiments described herein include enabling a clothes dryer to dry two loads of laundry in different chambers. In one aspect of the disclosure herein, laundry is tumbled in a treating chamber, while another load of laundry remains stationary is a separate container. Items, by way of non-limiting example, such as shoes or delicates, can withstand dryer temperatures, but tumbling can produce excessive noise or damage to the items.

In another aspect of the disclosure discussed herein, easy storage, and/or removal of the separate container as described herein enables a normal drying cycle to occur in the event a separate load of laundry does not require drying in a separate container.

Other benefits associated with other aspects of the disclosure discussed herein include enabling a drying cycle that can tumble two different loads at varying rates of rotation. Varying rates of rotation can enable gentle tumbling of certain laundry loads which can decrease drying times while still minimizing wear to laundry items due to tumbling.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims can be combined with each other in any possible combination, even if the combinations have not been expressly claimed.

What is claimed is:

1. A laundry treating appliance for drying laundry comprising:

a rotatable drum at least partially defining a first treating chamber and having a front and a rear;

at least one opening in the front providing access to the first treating chamber;

a first door selectively movable between an opened position and a closed position to open/close the at least one opening; and a separate container mounted to the first door and defining a second treating chamber disposed within the first treating chamber when the first door is in the closed position and configurable between a first and a second position, with the separate container forming a self-supporting structure in the second position;

wherein the first door defines at least a portion of the second treating chamber.

2. The laundry treating appliance of claim 1 wherein the first position is a non-use position and the self-supporting structure is in one of a stowed, a contracted, or a collapsed position.

3. The laundry treating appliance of claim 2 wherein the second position is a use position and the self-supporting structure is in an expanded position.

4. The laundry treating appliance of claim 3 wherein the expanded position forms a spherical shape or cylindrical shape.

5. The laundry treating appliance of claim 4 wherein the second treating chamber further comprises a second door to provide access to the second treating chamber.

6. The laundry treating appliance of claim 5 wherein the second door is located within the first door and can provide access to the second treating chamber while the first door remains in the closed position.

7. The laundry treating appliance of claim 5 wherein the second door comprises a screen face.

8. The laundry treating appliance of claim 7 wherein the separate container is removably mounted to the first door.

9. The laundry treating appliance of claim 2 wherein the separate container comprises a rigid framework.

10. The laundry treating appliance of claim 9 wherein a mesh face is reinforced by the rigid framework and separates the first treating chamber from the second treating chamber.

11. The laundry treating appliance of claim 10 wherein the mesh face is snapped to the rigid framework.

12. The laundry treating appliance of claim 11 wherein the separate container further comprises a mesh basket.

13. The laundry treating appliance of claim 2 wherein the separate container is mounted to the first door with a mounting arm and a coupler.

14. The laundry treating appliance of claim 13 wherein the coupler comprises a vertical extending ramp extending from an opening in which the mounting arm is received.

15. The laundry treating appliance of claim 14 wherein the vertical extending ramp extends from the opening to a notch along a quarter turn.

16. The laundry treating appliance of claim 1 wherein the separate container is rotatably mounted to the first door.

17. The laundry treating appliance of claim 16 wherein the separate container rotates independently of the rotatable drum.

18. The laundry treating appliance of claim 17 wherein a laundry load within the first treating chamber causes the separate container to be passively rotated.

19. A laundry treating appliance for drying laundry comprising:

a rotatable drum at least partially defining a first treating chamber and having a front and a rear;

at least one opening in the front providing access to the first treating chamber;

a first door selectively movable between an opened/closed position to open/close the at least one opening; and a separate container rotatably mounted within the first treating chamber with a set of bearings located between the front and the separate container and having a turning blade extending into the first treating chamber;

wherein the separate container rotates independently of the rotatable drum.

20. The laundry treating appliance of claim 19, wherein the turning blade enables the separate container to rotate independently of the rotatable drum.

* * * * *